US006565681B1

(12) United States Patent
Gravemann et al.

(10) Patent No.: US 6,565,681 B1
(45) **Date of Patent: *May 20, 2003**

(54) AGE-HARDENABLE COPPER ALLOY CASTING MOLDS

(75) Inventors: Horst Gravemann, Osnabrück (DE); Dirk Rode, Osnabrück (DE)

(73) Assignee: KM-Kabelmetal Aktiengesellschaft, Osnabrück (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/901,820

(22) Filed: Jul. 28, 1997

Related U.S. Application Data

(63) Continuation of application No. 08/740,034, filed on Oct. 23, 1996, now abandoned, which is a continuation of application No. 08/510,952, filed on Aug. 3, 1995, now abandoned.

(30) Foreign Application Priority Data

Aug. 6, 1994 (DE) ..... 44 27 939

(51) Int. Cl.[7] ..... C22C 9/06; B22D 11/12
(52) U.S. Cl. ..... 148/553; 148/435
(58) Field of Search ..... 148/435, 553; 420/485, 486, 487

(56) References Cited

U.S. PATENT DOCUMENTS 4,421,570 A 12/1983 Gravemann ..... 148/553
4,872,048 A * 10/1989 Akutsu et al. ..... 420/469

FOREIGN PATENT DOCUMENTS

| | | | |
|---|---|---|---|
| CA | A 2086063 | | 6/1993 |
| DE | A 3109438 | | 9/1982 |
| EP | A 0548636 | | 6/1993 |
| JP | A 58107460 | | 6/1983 |
| JP | 58107460 | * | 6/1983 |
| JP | A 58212839 | | 12/1983 |
| JP | 63-125632 | * | 5/1988 |
| JP | 63-303020 | * | 12/1988 |
| JP | A 01188642 | | 7/1989 |
| JP | 03-191034 | * | 8/1991 |
| JP | 04028837 | | 1/1992 |
| JP | 04-210438 | * | 7/1992 |
| WO | 90/11148 | * | 10/1990 |

OTHER PUBLICATIONS

Search Report for EP 95 11 0134.

* cited by examiner

*Primary Examiner*—Sikyin Ip
(74) *Attorney, Agent, or Firm*—Kenyon & Kenyon

(57) ABSTRACT

A method for manufacturing casting molds, in particular continuous casting molds which are used with an electromagnetic rabbling mechanism in the continuous casting of steel, is provided. The method comprises selecting a specified age-hardenable copper alloy to have a Ni content from 0.1 to 2.0% which allows the electrical conductivity of the copper alloy to be adjusted from 80 to 35 IACS. The method further comprises melting, casting, hot-rolling, solution heat treating and rapidly cooling the copper alloy, followed by age-hardening, wherein the mold has a tensile strength of at least 430 N/mm$^2$, is highly thermally conductive and exhibits low magnetic field damping. A method of using an age-hardenable copper alloy is also provided.

17 Claims, No Drawings

AGE-HARDENABLE COPPER ALLOY CASTING MOLDS

This application is a continuation of application Ser. No. 08/740,034, filed on Oct. 23, 1996 now abandoned, which is a continuation of application Ser. No. 08/510,952, filed on Aug. 3, 1995, now abandoned.

FIELD OF THE INVENTION

The present invention relates to the use of an age-hardenable copper alloy having a selectively adjustable electric conductivity for the manufacture of casting molds, in particular continuous casting molds, wherein molten metal is stirred by the action of electromagnetic forces.

BACKGROUND OF THE INVENTION

In the continuous casting of steel in particular, it is generally known that an improvement in quality can be achieved by the electromagnetic stirring of the molten mass contained in the cooled continuous casting molds. Using electromagnetic rabbling mechanisms, a desired flow is forced upon the liquid core of the molten metal within the solidified casting shell which prevents segregations from adversely affecting the cast structure of the billet during the solidification process.

During casting, the liquid molten metal is brought, within the rabbling mechanism, under the influence of an electrical rotating field transversely to the billet pull-off direction and set into vertical motion by the resulting induced currents, the motion running essentially concentrically to the longitudinal axis of the billet. As a result, a homogeneous cast structure is obtained which meets especially high quality demands. To keep the technical expenditure as low as possible, rabbling mechanisms are usually arranged underneath the mold so that the remaining molten metal in the partially solidified billet can be stirred immediately under the mold. To also be able to influence the solidifying structure where the outer edge areas of the billet solidify first, it is beneficial to place the rabbling mechanism either at the level of the mold or in the mold itself.

As a rule, the mold materials used in the continuous casting of steel have high thermal conductivity accompanied at the same time by high mechanical resistance in order to assure optimum heat dissipation and cooling capacity. This leads to a high maximum casting speed and increases the economic efficiency of the continuous steel casting. However, in the arrangement of an induction-rabbling mechanism, the high electric conductivity of the proven mold materials, as, for example, copper-chromium-zirconium alloys having IACS greater than 85%, proves to be disadvantageous. The high electric conductivity leads to an undesired high screening effect of the mold material with respect to the magnetic field produced for the purpose of stirring. This weakening of the magnetic field results in a stirring effect which is not as deep-acting. To compensate for this, the stirring action can be strengthened by increasing the current intensity. However, the technical expenditure necessary for that purpose rises disproportionally. Overall therefore, an optimum stirring action with current mold materials having high thermal conductivity is not attainable.

Mold materials having lower thermal conductivity are also already known. However, these mold materials have extremely high thermal resistances so that preferably they are used at higher temperatures. In addition, because of the extremely high thermal resistance, the machining of these mold materials is relatively costly. In addition, a further disadvantage is that the elongation-at-break at temperatures above 350° C. is too low.

Consequently the known mold materials having lower thermal conductivity do not represent an economic alternative to the highly conductive mold materials, as, for example, copper-chromium-zirconium alloys, for use in casting installations having an electromagnetic rabbling mechanism.

OBJECT OF THE PRESENT INVENTION

An object of the present invention is to provide an age-hardenable copper material, in particular for use in casting installations having an electromagnetic rabbling mechanism, the copper material producing a low field damping and furthermore possessing favorable resistance and elongation-at-break properties.

The means for attaining this objective consists in the use of an age-hardenable copper alloy of 0.1 to 2.0% nickel, 0.3 to 1.3% chromium, 0.1 to 0.5% zirconium, up to 0.2% of at least one element from the group consisting of phosphorous, lithium, calcium, magnesium, silicon and boron, the remainder copper and impurities. This invention provides for a selectively adjustable electric conductivity for manufacturing casting molds, in particular continuous casting molds, in cases where molten metal is stirred by the action of electromagnetic forces.

DETAILED DESCRIPTION OF THE INVENTION

Preferably the alloy to be used according to the present invention contains 0.4 to 1.6% nickel, 0.6 to 0.8% chromium, 0.15 to 0.25% zirconium, at least one element from the group consisting of 0.005 to 0.02% boron, 0.005 to 0.05% magnesium and 0.005 to 0.03% phosphorous, the remainder being copper including unavoidable impurities. The boron additive can be added to the molten mass as, for example, calcium boride.

Surprisingly, the copper alloy according to the present invention is distinguished by a particularly advantageous combination of mechanical and physical properties. With electric conductivity lying below 80% IACS, this copper alloy also meets the important demand for a low field damping of a mold wall produced from this alloy.

To further selectively increase resistance, it is advantageous to add in addition up to 0.2% titanium and/or 0.4% iron to the alloy. A small titanium content forms intermetallic compounds with the nickel and iron components present in the alloy which act to increase resistance.

Up to 0.8% aluminum and/or manganese likewise increase resistance, which can be used advantageously while only slightly influencing the low electric conductivity.

The invention is explained more precisely as follows with the aid of several exemplary embodiments. In Table 1, the composition of nine example alloys is specified in each case in percent by weight. X is to be understood as the total content of the individual elements boron, magnesium and/or phosphorous which are added up to a total of 0.05% as a deoxidant. Higher concentrations can likewise be used to increase the resistance of the alloy.

TABLE 1

| | Ni | Cr | Zr | X | Ti | Fe | Al | Mn | Cu |
|---|---|---|---|---|---|---|---|---|---|
| 1 | 0.20 | 0.70 | 0.18 | 0.015 | | | | | Remainder |
| 2 | 0.38 | 0.65 | 0.16 | 0.016 | | | | | Remainder |
| 3 | 0.65 | 0.60 | 0.20 | 0.012 | | | 0.41 | 0.25 | Remainder |
| 4 | 0.81 | 0.68 | 0.16 | 0.014 | | | | | Remainder |
| 5 | 0.81 | 0.66 | 0.17 | 0.014 | 0.10 | 0.22 | | | Remainder |
| 6 | 1.25 | 0.70 | 0.15 | 0.015 | | | | | Remainder |
| 7 | 1.60 | 0.66 | 0.18 | 0.016 | | | | | Remainder |
| 8 | 1.68 | 0.72 | 0.17 | 0.016 | | | | | Remainder |
| 9 | 2.0 | 0.73 | 0.16 | 0.013 | | | | | Remainder |

Copper alloys having nickel concentrations in a range of 0.2 to 2%, approximately 0.7% chromium, 0.16 to 0.2% zirconium, up to 0.02% boron, magnesium and/or phosphorous, the remainder being copper including impurities were studied. The alloys were first melted, cast to form rolling ingots and then hot-rolled at 950° C. in several passes with a total deformation of 65%. After a solution heat treatment of at least one hour at 1,030° C. and a subsequent rapid cooling in water, the rolled plates were age-hardened at least 4 hours at 475° C. After final cutting work, the mold plates, in each case dependent upon the nickel concentration (0.2 to 2% nickel), exhibited the properties summarized in Table 2. Where a range is given in Table 2, the first value corresponds to a property of the copper alloy of the invention having a nickel content of 0.2%.

TABLE 2

| | |
|---|---|
| Electric conductivity | 80 to 35% IACS |
| Softening temperature (10% drop in resistance at room temperature after 1 hour annealing time) | 525° C. |
| Hardness Brinell hardness 2.5/62 | 130 to 150 |
| Tensile strength | 430 to 450 N/mm$^2$ |
| Yield point | 325 to 340 N/mm$^2$ |
| Elongation at break | 28 to 22% |
| Thermal stability at 350° C. | 340 to 355 N/mm$^2$ |
| Yield point at 350° C. | 270 to 290 N/mm$^2$ |
| Elongation at break at 350° C. | 22 to 10% |

The alloys to be used according to the invention have an electric conductivity which can be adjusted by the choice of nickel concentration within the stated range of approximately 35 to 80% IACS, the mechanical properties remaining largely unaltered. With increasing nickel content up to 2.0%, within the entire concentration range, the yield point and the tensile strength of the material in the age-hardened state changes only slightly to higher characteristic values. A slight increase holds true also for the thermal stability, for example at 350° C. On the other hand, for the elongation-at-break, a value is also obtained which is largely independent of the nickel content, the value decreasing at a temperature-of 350° C. only to 10% elongation for an alloy having a nickel content of 2.0%.

In elongation-controlled fatigue tests, the stability of the alloy used according to the invention was tested both at room temperature as well as at a temperature up to 350° C.—corresponding to a cyclic temperature stress in the casting operation. In so doing, the formation of fatigue cracks revealed a substantial independence from the nickel content, so that the known favorable characteristics of the copper-chromium-zirconium alloys used till now in the casting operation are also exhibited in the present invention, providing a product with a long lifetime. The hardness, increasing with the rising nickel content, further improves quality, which also leads to a more favorable tribological behavior of the mold material.

The alloy mold according to the present invention is not restricted just to the plate molds described in the exemplary embodiments. Such advantages are also yielded in the case of other molds with which metallic molded billets can be produced in either a semicontinuous or fully continuous manner, for example tubular molds, ingot molds, casting wheels, and continuous cast and roll sheaths.

We claim:

1. A method for manufacturing a casting mold from a copper alloy comprising:

selecting an age-hardenable copper alloy consisting essentially of:

0.4 to 1.6% nickel, 0.6 to 0.8% chromium, 0.15 to 0.25% zirconium, at least one element selected from the group consisting of 0.005 to 0.02% boron, 0.005 to 0.05% magnesium and 0.005 to 0.03% phosphorous, the total content of boron, magnesium and phosphorous being from 0.005 up to 0.05%; up to 0.8% aluminum; up to 0.8% manganese; up to 0.4% iron; up to 0.2% titanium; up to 0.2% lithium; up to 0.2% calcium; up to 0.2% silicon; and the remainder being copper including impurities; and manufacturing a casting mold from the age-hardenable copper alloy;

wherein the manufacturing process includes the step of selecting the age-hardenable copper to have a Ni content from 0.4 to 1.6% which allows the electrical conductivity of the age-hardenable copper alloy to be adjusted from 80 to 35 IACS, wherein the manufacturing process further comprises the steps of:

melting the copper alloy;

casting the copper alloy;

hot-rolling the copper alloy;

solution heat treating the copper alloy; and rapidly cooling the copper alloy, followed by age-hardening, wherein the mold has a tensile strength of at least 430 N/mm$^2$, an elongation at break from 28 to 22%, is highly thermally conductive and exhibits low magnetic field damping.

2. A method of using an age-hardenable copper alloy comprising the steps of:

providing a casting mold, the casting mold being an age-hardenable copper alloy and having high thermal conductivity and low magnetic field damping, wherein the copper alloy consists essentially of 0.4 to 1.6% nickel;

0.6 to 0.8% chromium;

0.15 to 0.25% zirconium;

at least one element selected from the group consisting of 0.005 to 0.02% boron, 0.005 to 0.05% magnesium and 0.005 to 0.03% phosphorous, the total content of boron, magnesium and phosphorous being from 0.005 up to 0.05%; up to 0.8% aluminum; up to 0.8% manganese; up to 0.4% iron; up to 0.2% titanium; up to 0.2% lithium; up to 0.2% calcium; up to 0.2% silicon; and the remainder being copper including impurities, wherein the age-hardenable copper alloy has an electrical conductivity from 80 to 35 IACS by adjusting the nickel content from 0.4 to 1.6%, a tensile strength of at least 430 N/mm$^2$ and an elongation at break from 28 to 22%;

providing an electromagnetic rabbling mechanism, wherein the electromagnetic rabbling mechanism is capable of producing an electrical rotating field;

adding molten metal to the casting mold, wherein the molten metal is stirred as a result of electromagnetic forces from the electromagnetic rabbling mechanism, wherein the casting mold is manufactured by the method of claim 1.

3. The method of claim 2 wherein the alloy contains no added titanium.

4. A method of using an age-hardenable copper alloy comprising the steps of:

providing a casting mold, the casting mold being an age-hardenable copper alloy and having high thermal conductivity and low magnetic field damping, wherein the copper alloy consists of 0.4 to 1.6% nickel;

0.6 to 0.8% chromium;

0.15 to 0.25% zirconium;

at least one element selected from the group consisting of 0.005 to 0.02% boron, 0.005 to 0.05% magnesium and 0.005 to 0.03% phosphorous, the total content of boron, magnesium and phosphorous being from 0.005 up to 0.05; up to 0.8% aluminum; up to 0.8% manganese; up to 0.4% iron; up to 0.2% titanium; up to 0.2% lithium; up to 0.2% calcium; up to 0.2% silicon; and the remainder being copper including impurities wherein the age-hardenable copper alloy has an electrical conductivity from 80 to 35 IACS by adjusting the nickel content from 0.4 to 1.6%, a tensile strength of at least 430 N/mm$^2$ and an elongation at break from 28 to 22%;

providing an electromagnetic rabbling mechanism, wherein the electromagnetic rabbling mechanism is capable of producing an electrical rotating field;

adding molten metal to the casting mold, wherein the molten metal is stirred as a result of electromagnetic forces from the electromagnetic rabbling mechanism, wherein the casting mold is manufactured by the method of claim 1.

5. The method according to claim 1 wherein the copper alloy is cast to form a rolling ingot.

6. The method according to claim 1 wherein the copper alloy is hot-rolled at 950° C. with a total deformation of 65%.

7. The method according to claim 1 wherein the copper alloy is solution heat treated for at least one hour at 1,030° C.

8. The method according to claim 1 wherein the copper alloy is rapidly cooled in water.

9. The method according to claim 1 wherein the copper alloy is age-hardened at least 4 hours at 475° C.

10. The method according to claim 1 wherein the casting mold has an elongation at break at 350° C. from 22 to 10%.

11. The method according to claim 1 wherein the casting mold has a thermal stability at 350° C. from 340 to 355 N/mm$^2$.

12. The method according to claim 1 wherein the casting mold has a yield point at 350° C. from 270 to 290 N/mm$^2$.

13. The method according to claim 1 wherein the casting mold is selected from the group consisting of plate molds, tubular molds, ingot molds, casting wheels, continuous cast sheaths and continuous roll sheaths.

14. The method according to claim 1 wherein the casting mold has a tensile strength from 430 to 450 N/mm$^2$.

15. The method of claim 1 wherein the alloy contains no added titanium.

16. A method for manufacturing a casting mold from a copper alloy comprising:

selecting an age-hardenable copper alloy consisting of:

0.4 to 1.6% nickel, 0.6 to 0.8% chromium, 0.15 to 0.25% zirconium, at least one element selected from the group consisting of 0.005 to 0.02% boron, 0.005 to 0.05% magnesium and 0.005 to 0.03% phosphorous, the total content of boron, magnesium and phosphorous being from 0.005 up to 0.05%; up to 0.8% aluminum; up to 0.8% manganese; up to 0.4% iron; up to 0.2% titanium; up to 0.2% lithium; up to 0.2% calcium; up to 0.2% silicon; and the remainder being copper including impurities; and manufacturing a casting mold from the age-hardenable copper alloy;

wherein the manufacturing process includes the step of selecting the age-hardenable copper to have a Ni content from 0.4 to 1.6% which allows the electrical conductivity of the age-hardenable copper alloy to be adjusted from 80 to 35 IACS, the casting mold having a tensile strength of at least 430 N/mm$^2$ and an elongation at break from 28 to 22%.

17. A method for manufacturing a casting mold from a copper alloy comprising:

selecting an age-hardenable copper alloy comprised of:

0.4 to 1.6% nickel, 0.6 to 0.8% chromium, 0.15 to 0.25% zirconium, at least one element selected from the group consisting of 0.005 to 0.02% boron, 0.005 to 0.05% magnesium and 0.005 to 0.03% phosphorous, the total content of boron, magnesium and phosphorous being from 0.005 up to 0.05%; and the remainder being copper including impurities; and manufacturing a casting mold from the age-hardenable copper alloy;

wherein the manufacturing process includes the step of selecting the age-hardenable copper to have a Ni content from 0.4 to 1.6% which allows the electrical conductivity of the age-hardenable copper alloy to be adjusted from 80 to 35 IACS, the manufacturing process further comprising the steps of:

melting the copper alloy;

casting the copper alloy to form a rolling ingot;

hot-rolling the copper alloy at 950° C. with a total deformation of 65%;

solution heat treating the copper alloy for at least one hour at 1,030° C.; and rapidly cooling the copper alloy in water, followed by age-hardening for at least 4 hours at 475° C., the manufacturing process including forming the copper alloy into a mold, wherein the mold has a tensile strength of at least 430 N/mm$^2$, an elongation at break from 28 to 22%, is highly thermally conductive and exhibits low magnetic field damping.

* * * * *